US012766430B2

(12) United States Patent
Kamiyama

(10) Patent No.: US 12,766,430 B2
(45) Date of Patent: Oct. 20, 2026

(54) MODEL TOY AND COOKING TOY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 153 days.

(21) Appl. No.: 18/932,961

(22) Filed: Oct. 31, 2024

(65) Prior Publication Data

US 2025/0135371 A1 May 1, 2025

(30) Foreign Application Priority Data

Nov. 1, 2023 (JP) ..... 2023-187373

(51) Int. Cl.
*A63H 33/30* (2006.01)
*A63H 3/52* (2022.01)

(52) U.S. Cl.
CPC ..... *A63H 33/3055* (2013.01); *A63H 3/52* (2013.01)

(58) Field of Classification Search
CPC ..... A63H 33/3055; A63H 3/52
USPC ..... 446/481
See application file for complete search history.

(56) References Cited

U.S. PATENT DOCUMENTS 3,058,259 A * 10/1962 Kripak ..... A63H 33/30 446/481
3,808,730 A * 5/1974 Cooper ..... A63H 33/3055 446/481
5,314,373 A * 5/1994 Caveza ..... A63H 33/3055 446/481
5,528,014 A * 6/1996 Goldberg ..... H05B 6/6417 446/481
5,716,253 A * 2/1998 Aoki ..... A63H 33/22 446/481
8,568,193 B1 * 10/2013 Evans ..... A63H 33/3055 446/168
10,787,308 B1 * 9/2020 Larson ..... B42D 15/045
12,589,325 B2 * 3/2026 Percy-Hughes ... A63H 33/3055
D1,124,168 S * 4/2026 Nakanishi ..... D21/524
2007/0093171 A1 * 4/2007 Chan ..... A63H 3/52 446/268

(Continued)

FOREIGN PATENT DOCUMENTS

JP 2018-164492 A 10/2018

*Primary Examiner* — Kristina R Fulton
(74) *Attorney, Agent, or Firm* — Faegre Drinker Biddle & Reath LLP

(57) ABSTRACT

A model toy includes: a placement table provided in a main body and having a main body-side through hole; a tray having a tray-side through hole and placed on the placement table such that the tray-side through hole overlaps the main body-side through hole in a vertical direction; a rotation shaft provided below the placement table; a conversion part configured to convert a rotational motion of the rotation shaft into a reciprocating motion in the vertical direction; and a moving part provided between the placement table and the conversion part and configured to move in the vertical direction by interference with the conversion part in accordance with a rotation of the rotation shaft. The moving part includes a penetration portion configured to pass through the main body-side through hole and the tray-side through hole and protrude upward from the tray-side through hole by moving upward.

7 Claims, 14 Drawing Sheets

(56) References Cited

U.S. PATENT DOCUMENTS

| | | | | |
|---|---|---|---|---|
| 2009/0253346 | A1* | 10/2009 | Ehama | A63H 33/3055<br>446/267 |
| 2020/0368634 | A1* | 11/2020 | Kamiyama | A63H 33/3055 |
| 2020/0384379 | A1* | 12/2020 | Kamiyama | A63H 33/3055 |
| 2024/0139642 | A1* | 5/2024 | Kamiyama | A63H 33/3055 |
| 2025/0135371 | A1* | 5/2025 | Kamiyama | A63H 33/3055 |
| 2025/0135372 | A1* | 5/2025 | Kamiyama | A63H 33/42 |

* cited by examiner

MODEL TOY AND COOKING TOY

CROSS-REFERENCE TO RELATED APPLICATIONS

This application is based on and claims priority under 35 USC 119 from Japanese Patent Application No. 2023-187373 filed on Nov. 1, 2023, the contents of which are incorporated herein by reference.

TECHNICAL FIELD

The present disclosure relates to a model toy and a cooking toy.

BACKGROUND ART

In the related art, model toys imitating kitchenware are provided. For example, JP2018-164492A discloses, as a toy set, an imitation oven in which an intermediate material obtained by mixing a base material and a foaming agent can be input. When the intermediate material produced as a dough of imitation bread is input into the imitation oven, the intermediate material rises with a thickness of about 1.2 times after 20 minutes. Then, a color, which imitates baking, is added by applying an oily agent to the imitation bread after drying.

SUMMARY OF INVENTION

In the above-described model toy disclosed in JP2018-164492A, however, a time is required to obtain the imitation bread after cooking from the input of the imitation break, and thus a play imitating a state change before and after cooking cannot be easily enjoyed.

An object of the present disclosure is to provide a model toy and a cooking toy for easily enjoying a play imitating a state change before and after cooking.

A model toy according to an aspect of the present disclosure includes: a main body; a placement table provided in the main body and having at least one main body-side through hole penetrating through the placement table in a vertical direction; a tray having at least one tray-side through hole penetrating through the tray in the vertical direction and being placed on the placement table such that the at least one tray-side through hole overlaps the at least one main body-side through hole in the vertical direction; a rotation shaft provided below the placement table; an operation part provided in the main body and configured to rotationally operate the rotation shaft; at least one conversion part provided around an axis of the rotation shaft and configured to convert a rotational motion of the rotation shaft around the axis into a reciprocating motion in the vertical direction; and at least one moving part provided between the placement table and the at least one conversion part and configured to move in the vertical direction by interference with the at least one conversion part in accordance with a rotation of the rotation shaft around the axis, in which the at least one moving part includes at least one penetration portion configured to pass through the at least one main body-side through hole and the at least one tray-side through hole and protrude upward from the at least one tray-side through hole by moving upward.

A cooking toy according to an aspect of the present disclosure includes: a main body; a placement table provided in the main body and having a main body-side through hole penetrating through the placement table in a vertical direction; a tray having a tray-side through hole penetrating through the tray in the vertical direction and being placed on the placement table such that the tray-side through hole overlaps the main body-side through hole in the vertical direction; a rotation shaft provided below the placement table; an operation part provided in the main body and configured to rotationally operate the rotation shaft; a conversion part provided around an axis of the rotation shaft and configured to convert a rotational motion of the rotation shaft around the axis into a reciprocating motion in the vertical direction; a moving part provided between the placement table and the conversion part and configured to move in the vertical direction by interference with the conversion part along with the rotation of the rotation shaft around the axis; and a figure body imitating a shape of a cooking object, in which the tray includes a storing part having the tray-side through hole and configured to allow the figure body to be stored in the storing part so as to be movable upward, in which the moving part includes a penetration portion configured to pass through the main body-side through hole and the tray-side through hole and protrude upward from the tray-side through hole by moving upward.

According to the present disclosure, it is possible to provide a model toy and a cooking toy for easily enjoying a play imitating a state change before and after cooking.

BRIEF DESCRIPTION OF DRAWINGS

The present disclosure will be described in detail based on the following without being limited thereto, wherein:

FIGS. 9A to 9C are perspective views showing an operation of the oven toy according to the first embodiment of the present disclosure, in which FIG. 9A shows the oven toy in which a cake piece is in a pre-cooking state, FIG. 9B shows the oven toy in which the cake piece is in a semi-cooking state, and FIG. 9C shows the oven toy in which the cake piece is in a post-cooking state;

FIGS. 10A to 10C are cross-sectional views showing an operation of the oven toy according to the first embodiment of the present disclosure, in which FIG. 10A is a longitudinal cross-sectional view of a main part taken at a center in a left-right direction of FIG. 9A, FIG. 10B is a longitudinal cross-sectional view of the main part taken at a center in the left-right direction of FIG. 9B, and FIG. 10C is a cross-sectional view of the main part taken at a center in the left-right direction of FIG. 9C;

FIGS. 14A to 14C are perspective views showing an operation of the oven toy according to the second embodiment of the present disclosure, in which FIG. 14A shows the oven toy in which a small cake piece is in the pre-cooking state, FIG. 14B shows the oven toy in which the small cake piece is in the semi-cooking state, and FIG. 14C shows the oven toy in which the small cake piece is in the post-cooking state.

DESCRIPTION OF EMBODIMENTS

First Embodiment

Figure 1:
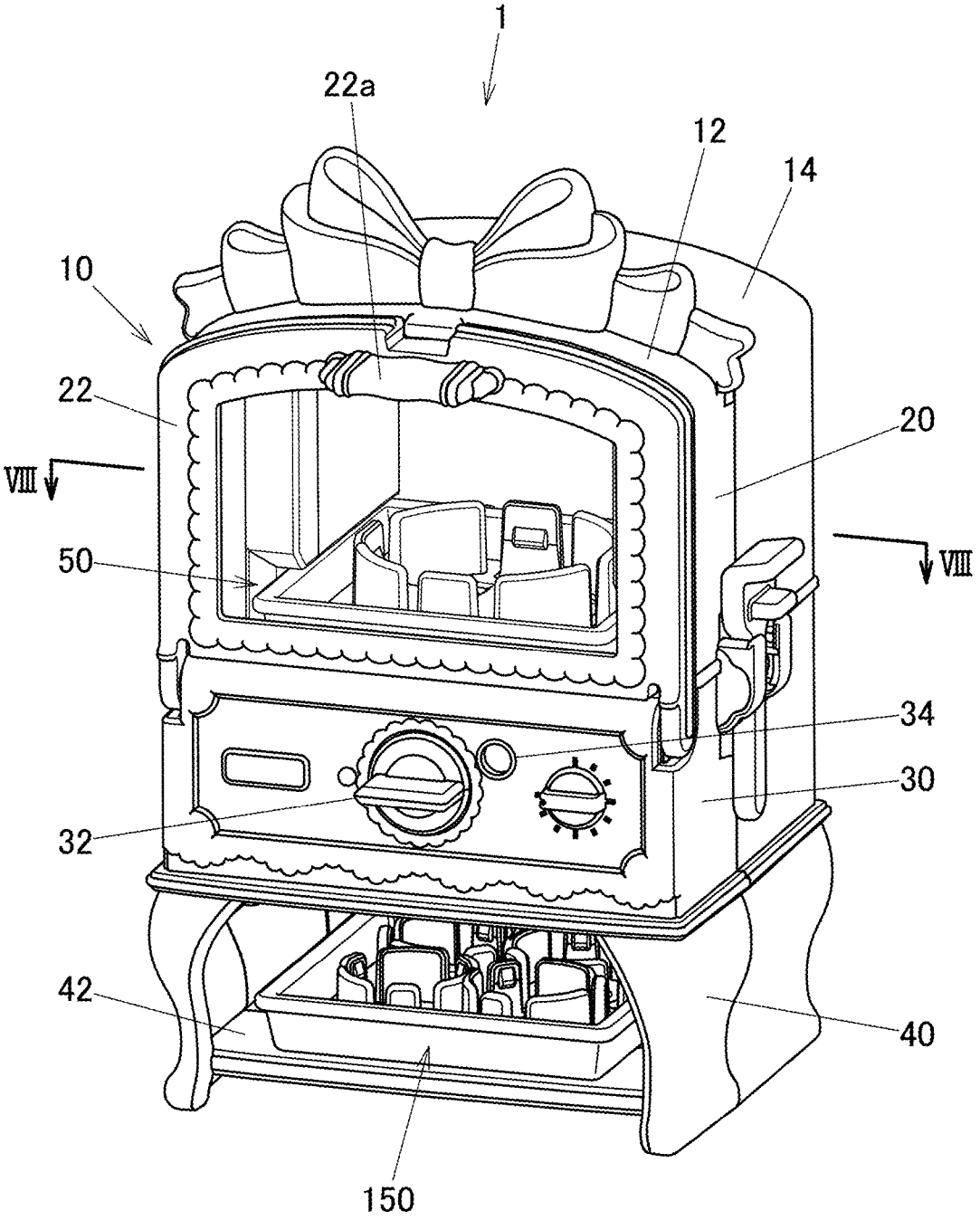
FIG. 1 is an overall perspective view of an oven toy according to a first embodiment of the present disclosure.
Figure 2:
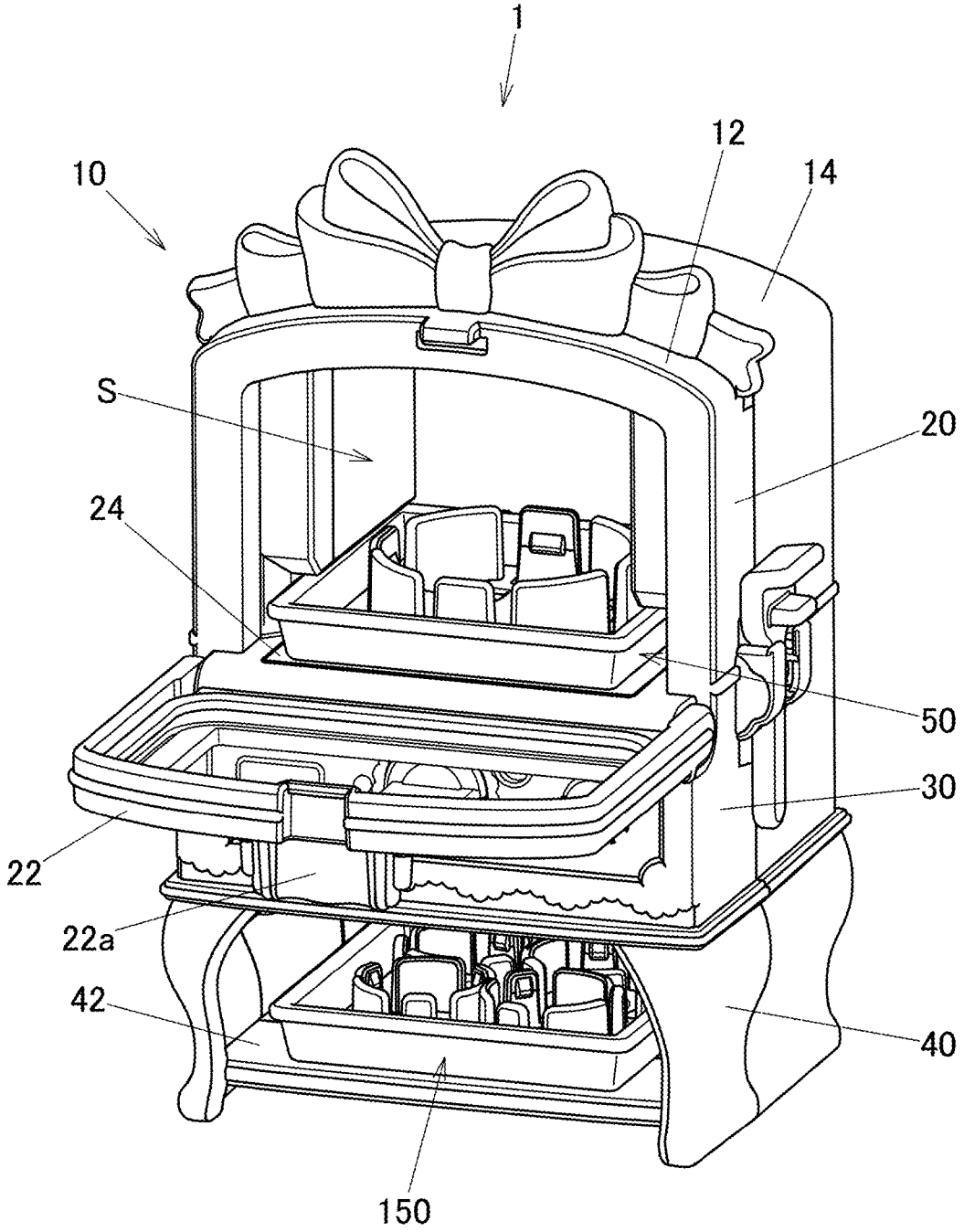
FIG. 2 is an overall perspective view of the oven toy according to the first embodiment of the present disclosure with a door opened.

A first embodiment of the present disclosure will be described with reference to FIGS. 1 to 10C. As shown in FIG. 1, in the first embodiment of the present disclosure, an oven toy (model toy, cooking toy) 1 imitating an oven is exemplified. The oven toy 1 is a toy that allows for pretend cooking with a doll or the like. The oven toy 1 is formed in a substantially rectangular parallelopiped body shape, which is long longitudinally, and includes a main body 10 provided with an oven 20, an operation part 30, and a leg part 40. The oven 20 is provided on an upper part of the main body 10 and can be opened and closed by a door portion 22. In the following description, the door portion 22 side of the main body 10 is referred to as a front side of the oven toy 1, an opposite side thereto is referred to as a rear side, and a right side when the main body 10 is viewed from the front side is referred to as a right side of the oven toy 1, and an opposite side thereto is referred to as a left side.

An upper end portion of the door portion 22 is provided with a handle portion 22*a*, which is a handle having a projection shape protruding forward. The door portion 22 is connected to the main body 10 at a lower end portion so as to be rotatable about an axis with the left-right direction as an axial direction, and can be opened forward by a user while holding the handle portion 22*a* (see FIG. 2). A lower surface of a space S inside the oven 20, which is exposed by opening the door portion 22, is provided with a placement plate (placement table) 24 having a substantially rectangular plate shape (see FIG. 2). In the present embodiment, a configuration is exemplified in which a first tray 50 imitating a cake pan for a whole cake is placed on the placement plate 24. The first tray 50 can be removed from the placement plate 24. In addition to the first tray 50, a second tray 150, which will be described below, or the like can be placed on the placement plate 24.

The operation part 30 is provided on a lower side of the oven 20 and has a shape imitating a control panel of the oven 20. A front surface of the operation part 30 is provided with a switch portion 32, which has a shape imitating a cookstove switch and can be rotationally operated, and a display portion 34, which is a generally circular opening. The leg part 40 has a leg shape supporting both left and right sides of the oven 20 and is provided on a lower side of the operation part 30. Between legs on both left and right sides of the leg part 40, a shelf-shaped shelf portion 42 is provided. On the shelf portion 42, a second tray 150, which will be exemplified in a second embodiment, is placed.

For the oven toy 1, the user opens the door portion 22 of the oven 20, stores a figure body imitating, for example, a sponge cake, into the first tray 50, closes the door portion 22, and rotationally operates the switch portion 32. Then, the figure body inside the first tray 50 is raised upward by a rotation conversion mechanism 60 described below, and the user playing with the oven toy 1 feels as if the sponge cake inside the oven 20 has risen. The oven toy 1 is a toy that can be enjoyed by imitating cooking in this way. Below, the configuration of each member of the oven toy 1 will be described in detail.

Figure 3:
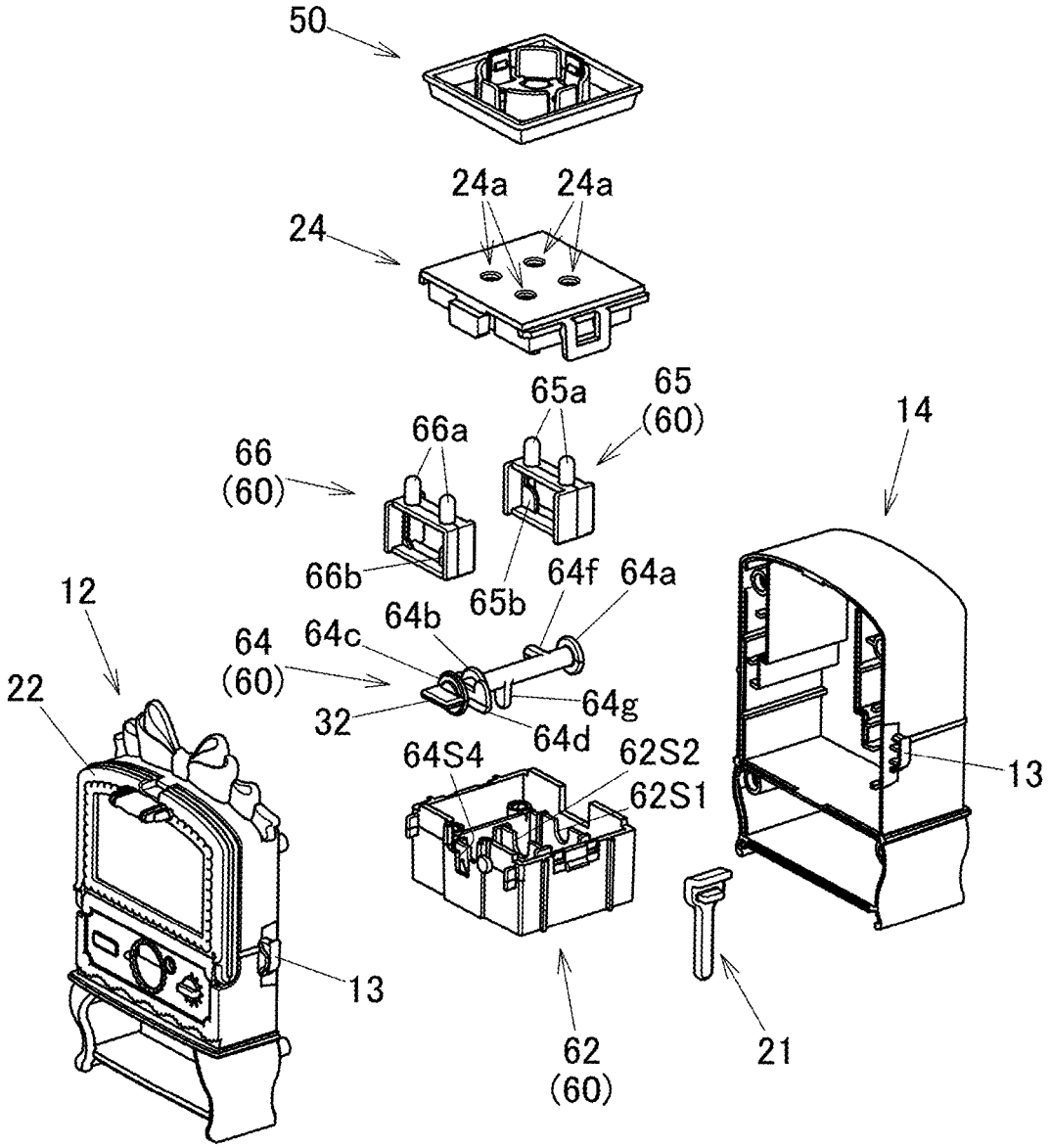
FIG. 3 is an exploded perspective view of the oven toy according to the first embodiment of the present disclosure.

As shown in FIG. 3, the main body 10 includes a front case 12 constituting the front side of the oven toy 1, a rear case 14 constituting the rear side of the oven toy 1, the placement plate 24, and a rotation conversion mechanism 60 provided on a lower side of the placement plate 24 inside the main body 10, which are integrally assembled (note that FIG. 3 also shows the first tray 50 placed on the placement plate 24). A right side surface of the front case 12 and a right side surface of the rear case are provided with a detachable portion 13, which becomes two parallel short straight projections when the front case and the rear case are assembled in the front-rear direction. The detachable portion 13 allows a handle component 21, which imitates the shape of the handle of the oven 20, to be attached and detached.

Figure 4:
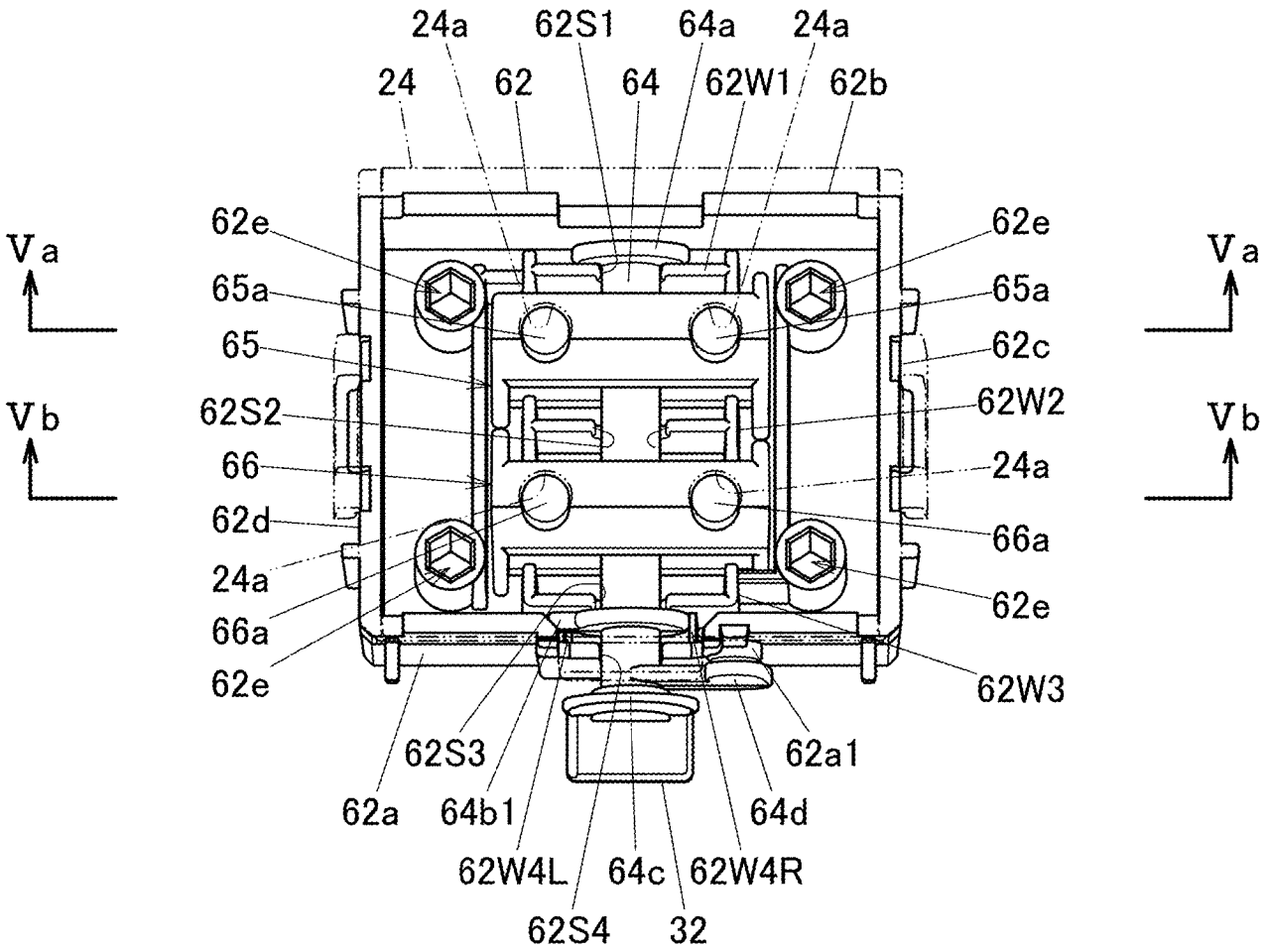
FIG. 4 is a perspective view of a rotation conversion mechanism of the oven toy according to the first embodiment of the present disclosure as viewed from above.

As shown in FIGS. 3 and 4, the rotation conversion mechanism 60 includes a housing 62, a rotation shaft 64, a first moving part 65, and a second moving part 66. The housing 62 has a substantially box-like shape opening upward, and stores the rotation shaft 64 therein, as well as the first moving part 65 and the second moving part 66. The upper opening of the housing 62 substantially matches external dimensions and shape of the placement plate 24, and is closed using the placement plate 24 as a lid. Hereinafter, an outer wall on the front side of the housing 62 is referred to as a front outer wall 62*a*, an outer wall on the rear side is referred to as a rear outer wall 62*b*, an outer wall on the right side is referred to as a right outer wall 62*c*, and an outer wall on the left side is referred to as a left outer wall 62*d*.

The housing 62 is provided therein with a first wall portion 62W1, a second wall portion 62W2, and a third wall portion 62W3 in the form of walls standing upright from a bottom surface in the housing 62, in order from the rear side. The first wall portion 62W1 includes a portion extending in the left-right direction in the vicinity of the rear outer wall 62*b* and a portion extending in the front-rear direction in the vicinity of the left outer wall 62*d*. The third wall portion 62W3 includes a portion extending in the left-right direction in the vicinity of the front outer wall 62*a* and a portion extending in the front-rear direction in the vicinity of the right outer wall 62*c*. The second wall portion 62W2 extends in the left-right direction between the first wall portion 62W1 and the third wall portion 62W3.

In addition, a right fourth wall portion 62W4R extending in the front-rear direction is provided between the third wall portion 62W3 and the front outer wall 62*a* and on a right side of a third flange portion 64*c* of the rotation shaft 64 described below, and a left fourth wall portion 62W4L extending in the front-rear direction is provided between the third wall portion 62W3 and the front outer wall 62*a* and on a left side of the third flange portion 64*c*.

In addition, at a substantially central portion in the left-right direction of the housing 62, a first shaft support 62S1, a second shaft support 62S2, a third shaft support 62S3, and a fourth shaft support 62S4, on which the rotation shaft 64 is supported, are arranged in a row at intervals in the front-rear direction in order from the rear side. Each of the shaft supports 62S1 to 62S4 is cut in a substantially arc shape along an outer periphery of the rotation shaft 64 in an upwardly open form. The first shaft support 62S1 is formed at a portion extending in the left-right direction of the first wall portion 62W1 of the housing 62. The second shaft support 62S2 is formed on the second wall portion 62W2. The third shaft support 62S3 is formed at a portion extending in the left-right direction of the third wall portion 62W3 of the housing 62. The fourth shaft support 62S4 is formed on the front outer wall 62*a* of the housing 62.

Both end portions of a portion extending in the front-rear direction of the first wall portion 62W1 and both end portions of a portion extending in the front-rear direction of the third wall portion 62W3 are provided with engaging holes 62*e* in the shape of a hole opening upward. Note that portions of the lower surface of the placement plate 24, which overlap the respective engaging holes 62*e* in the vertical direction, are provided with projections (not shown), which protrude downward and can engage with the engaging holes 62*e*, respectively. The placement plate 24 is assembled to the upper part of the housing 62 by engaging each projection on the lower surface with each engaging hole 62*e* of the housing 62.

Note that in the housing 62, a substantially central portion of the front outer wall 62*a* in the left-right direction protrudes slightly forward in a step shape. The protruding portion is formed with the fourth shaft support 62S4. In addition, a right end portion of the protruding portion is formed as a covered portion 62*a*1, which is covered by a covering portion 64*d* of the rotation shaft 64 described below. The covered portion 62*a*1 is provided at a position overlapping the display portion 34 (see FIG. 1) in the front-rear direction.

The rotation shaft 64 is a member having a substantially cylindrical shape and is arranged within the housing 62 with its axial direction oriented in the front-rear direction. An outer peripheral surface of the rotation shaft 64 is provided with a first flange portion 64*a*, a second flange portion 64*b*, and a third flange portion 64*c* in the shape of flanges at intervals in order from the rear side. The first flange portion 64*a* is provided at a rear end portion of the rotation shaft 64. The third flange portion 64*c* is provided at a front end portion of the rotation shaft 64. The second flange portion 64*b* is formed in the vicinity of the third flange portion 64*c*. The rotation shaft 64 is rotatably supported on the first shaft support 62S1, the second shaft support 62S2, and the third shaft support 62S3 between the first flange portion 64*a* and the second flange portion 64*b*, and is rotatably supported on the fourth shaft support 62S4 between the second flange portion 64*b* and the third flange portion 64*c*.

Each of the flange portions 64*a* to 64*c* is formed to have a diameter larger than a dimension in the left-right direction of each of the shaft supports 62S1 to 62S4. For this reason, the rotation shaft 64 is prevented from coming off in the front-rear direction by each of the flange portions 64*a* to 64*c*. An outer peripheral surface of the second flange portion 64*b* is provided with a rotation regulating portion 64*b*1 extending slightly leftward. A lower portion of the rotation regulating portion 64*b* 1 is in contact with a tip end portion of the left fourth wall portion 62W4L of the housing 62, and thereby regulating a counterclockwise rotation of the rotation shaft 64 when viewed from the front side.

Additionally, an outer peripheral surface between the second flange portion 64*b* and the third flange portion 64*c* is provided with a covering portion 64*d* extending rightward. A tip end portion of the cover portion 64*d* is located between the display portion 34 and the covered portion 62*a*1 of the housing 62, and covers a front side of the covered portion 62*a*1. Note that the switch portion 32 is integrally provided on a front surface of the third flange portion 64*c*. By rotationally operating the switch portion 32, the rotation shaft 64 rotates around its axis.

Figure 5A:
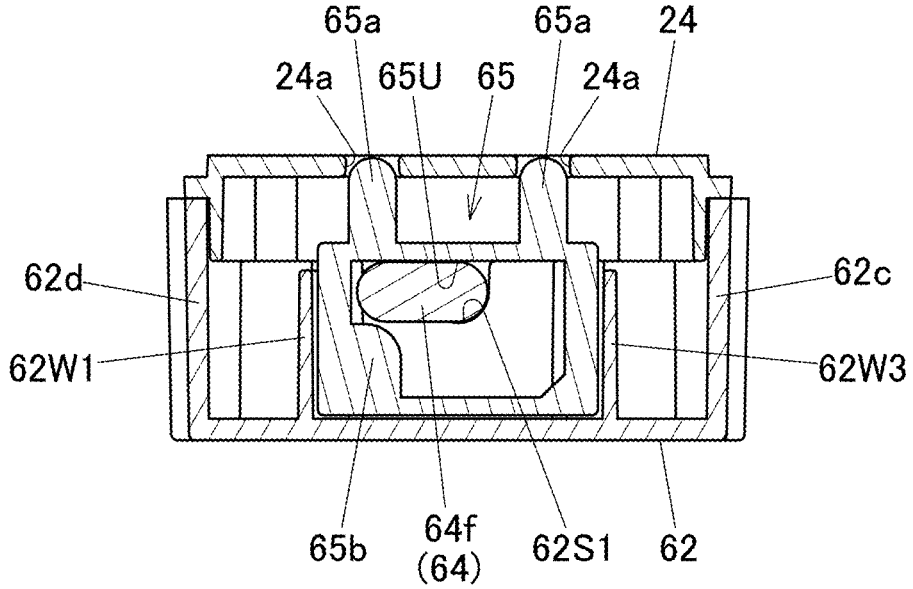
FIG. 5A is a cross-sectional taken along line Va-Va in FIG. 4.
Figure 5B:
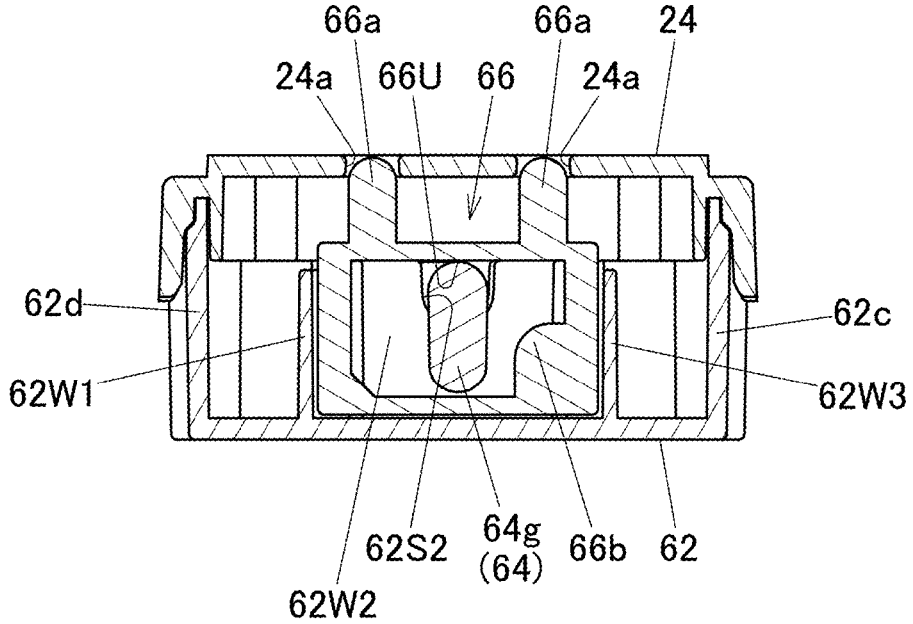
FIG. 5B is a cross-sectional view taken along line Vb-Vb in FIG. 4.

In addition, as shown in FIG. 3 and FIG. 5A, at a position, which is near the first flange portion 64*a*, on the outer peripheral surface between the first flange portion 64*a* and the second flange portion 64*b*, a first interference portion (conversion part, first conversion part) 64*f* is provided which protrudes in a substantially plate-like shape in the left direction (radial direction) with both plate surfaces oriented in the front-rear direction. Note that, as shown in FIG. 3 and FIG. 5B, at a position, which is near the second flange portion 64*b*, on the outer peripheral surface between the first flange portion 64*a* and the second flange portion 64*b*, a second interference portion (conversion part, second conversion part) 64*g* is provided which protrudes in a substantially plate-like shape in the downward direction (radial direction) with both plate surfaces oriented in the front-rear direction. Note that the protruding tip end portions of the first interference portion 64*f* and the second interference portion 64*g* are both chamfered and rounded.

The first moving part 65 and the second moving part 66 are members having the same structure of a rectangular ring shape including four substantially plate-shaped wall portions, and are stored in the housing 62 such that they are oriented in reverse directions relative to each other. The first moving part 65 is stored so as to be movable in the vertical direction between the first wall portion 62W1 and the second wall portion 62W2 within the housing 62 so as to surround the first interference portion 64*f* of the rotation shaft 64, in a posture where the rotation shaft 64 is inserted inside. The second moving part 66 is stored so as to be movable in the vertical direction between the second wall portion 62W2 and the third wall portion 62W3 within the housing 62 so as to surround the second interference portion 64*g* of the rotation shaft 64, in a posture where the rotation shaft 64 is inserted inside.

An upper surface of the first moving part 65 is provided with two first pins (penetration portion) 65*a* protruding upward in the form of being aligned in the left-right direction. Similarly, an upper surface of the second moving part 66 is also provided with two second pins (penetration portion) 66*a* protruding upward in the form of being aligned in the left-right direction. Each first pin 65*a* and each second pin 66*a* have the same shape and protrude at the same height, and are arranged such that when viewed from above, line segments connecting tip ends of the four pins 65*a* and 66*a* form a substantially square shape (see FIG. 4). On the other hand, at positions, which overlap the respective pins 65*a* and 66*a* in the vertical direction, on the placement plate 24, main body-side through holes 24*a*, which are substantially circular openings through which the respective pins 65*a* and 66*a* can pass, are provided.

As shown in FIG. 5A, a lower left side of an inner surface (a surface exposed toward the rotation shaft 64) of the first moving part 65 is provided with a first protruding portion 65*b* protruding inward (toward the rotation shaft 64) in the shape of a wall. The first protruding portion 65*b* is provided on the same plane as the first interference portion 64*f* of the rotation shaft 64 in a plane (cross section shown in FIG. 5A) orthogonal to the axis direction (front-rear direction) of the rotation shaft 64, and its tip end portion protrudes to a position in the vertical direction where it approaches or contacts the first interference portion 64*f*. Note that the tip end portion of the first protruding portion 65*b* is chamfered into a substantially arc shape in the cross section shown in FIG. 5A.

As shown in FIG. 5A, the rotation shaft 64 inserted into the inner side of the first moving part 65 is arranged in the form of being close to or in contact with an upper portion 65U on the inner side of the first moving part 65. A protrusion dimension of the first interference portion 64*f* from the rotation shaft 64 is larger than an interval between the rotation shaft 64 and the upper portion 65U of the inner surface of the first moving part 65, and is also smaller than an interval between the rotation shaft 64 and a portion (excluding the first protruding portion 65*b*) other than the upper portion 65U of the inner surface of the first moving part 65. For this reason, when the rotation shaft 64 is rotationally operated by the switch portion 32, the first interference portion 64*f* interferes with the first protruding portion 65*b* and also interferes with the upper portion 65U of the inner surface of the first moving part 65.

In addition, as shown in FIG. 5B, a lower right side of an inner surface (a surface exposed toward the rotation shaft 64) of the second moving part 66 is provided with a second protruding portion 66*b* protruding inward (toward the rotation shaft 64) in the shape of a wall. The second protruding portion 66*b* is provided on the same plane as the second interference portion 64*g* of the rotation shaft 64 in a plane (cross section shown in FIG. 5B) orthogonal to the axis direction (front-rear direction) of the rotation shaft 64, and its tip end portion protrudes to a position in the left-right direction where it approaches or contacts the second interference portion 64*g*. Note that the tip end portion of the second protruding portion 66*b* is chamfered into a substantially arc shape in the cross section shown in FIG. 5B, similarly to the first protruding portion 65*b*.

As shown in FIG. 5B, the rotation shaft 64 inserted into the inner side of the second moving part 66 is arranged in the form of being close to or in contact with an upper portion 66U on the inner side of the second moving part 66. A protrusion dimension of the second interference portion 64*g* from the rotation shaft 64 is larger than an interval between the rotation shaft 64 and the upper portion 66U of the inner surface of the second moving part 66, and is also smaller than an interval between the rotation shaft 64 and a portion (excluding the second protruding portion 66*b*) other than the upper portion 66U of the inner surface of the second moving part 66. For this reason, when the rotation shaft 64 is rotationally operated by the switch portion 32, the second interference portion 64*g* interferes with the second protruding portion 66*b* and also interferes with the upper portion 66U of the inner surface of the second moving part 66.

Figure 6:
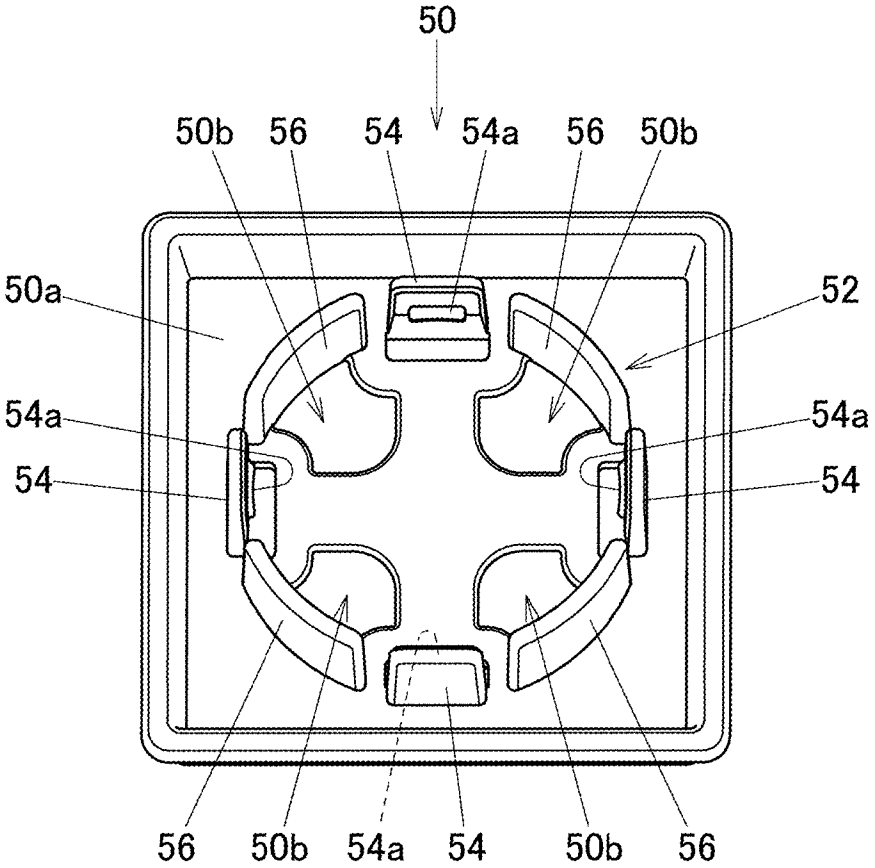
FIG. 6 is a perspective view of a tray of the oven toy according to the first embodiment of the present disclosure as viewed from above.

Next, the configuration of the first tray 50 that is placed on the placement plate 24 in the present embodiment will be described with reference to FIG. 6. As shown in FIG. 6, the first tray 50 has a shallow dish shape, which has a substantially square shape when viewed from above. On a bottom surface 50*a* of the first tray 50, a storing part 52 in which a cake model (figure body) M1 described below is stored is provided. The storing part 52 is constituted by wall portions rising from the bottom surface 50*a* of the first tray 50, and has a substantially circular shape following an outer peripheral surface of the cake model M1 when viewed from above.

The wall portions constituting the storing part 52 are intermittently provided in the form of being divided into eight pieces, and among them, the four wall portions located on the front, rear, left, and right sides (wall portions provided in a substantially straight-line shape when viewed from above) serve as holding portions 54 that hold the cake model M1, and the other four wall portions (wall portions provided in a substantially arc shape when viewed from above) serve as non-holding portions 56. An inner surface side of each holding portion 54 is provided with a claw portion 54*a* protruding in a claw shape toward the inner side (a center side of the first tray 50). Note that in the storing part 52 of the bottom surface 50*a* of the first tray 50, an opening is provided at a portion located directly below each holding portion 54 along a base end portion of each holding portion 54, and thus, each holding portion 54 is easily elastically deformed in a leaf spring-like manner both inward and outward of the first tray 50.

In addition, in the storing part 52 of the bottom surface 50*a* of the first tray 50, a tray-side through hole 50*b*, which is an opening, is provided at a portion located on an inner side of each non-holding portion 56. Each tray-side through hole 50*b* is provided at a position, which overlaps each main body-side through hole 24*a* in the vertical direction when the first tray 50 is placed on the placement plate 24, and each of the pins 65*a* and 66*a* can pass therethrough (see FIG. 8).

Figure 7A:
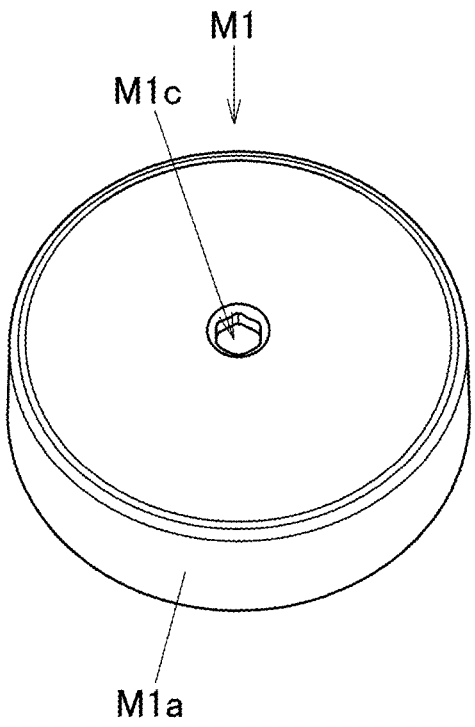
FIG. 7A is a perspective view of a cake piece as viewed from above.
Figure 7B:
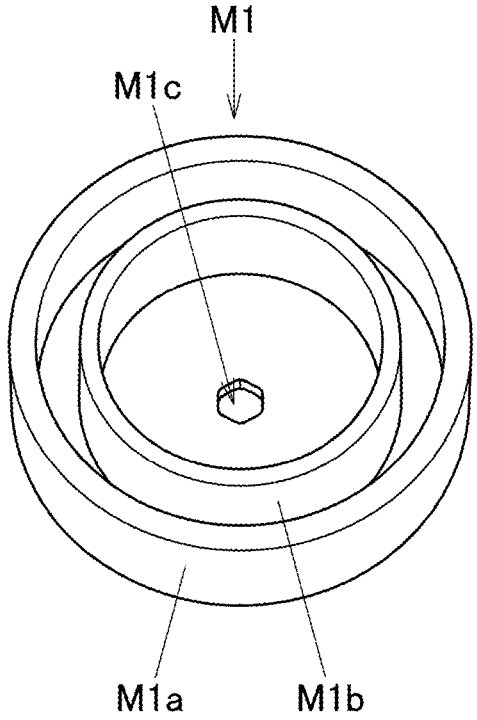
FIG. 7B is a perspective view of the cake piece as viewed from below.

Next, the cake model M1 that is stored in the storing part 52 will be described with reference to FIGS. 7A and 7B. The cake model M1 is a figure body imitating a sponge cake (cooking object) and is a short cylindrical member with a closed upper opening. As shown in FIG. 7B, on an inner side of the cake model M1, an inner peripheral wall M1*b* having a substantially circular shape following an outer peripheral wall M1*a* of the cake model M1 and a wall shape slightly smaller than the outer peripheral wall M1*a* is provided concentrically with the outer peripheral wall M1*a*. Note that as shown in FIGS. 7A and 7B, a small circulation opening M1*c*, which serves as an air circulation path in the event of accidental swallowing, is provided at a central portion of the upper surface of the cake model M1.

Figure 8:
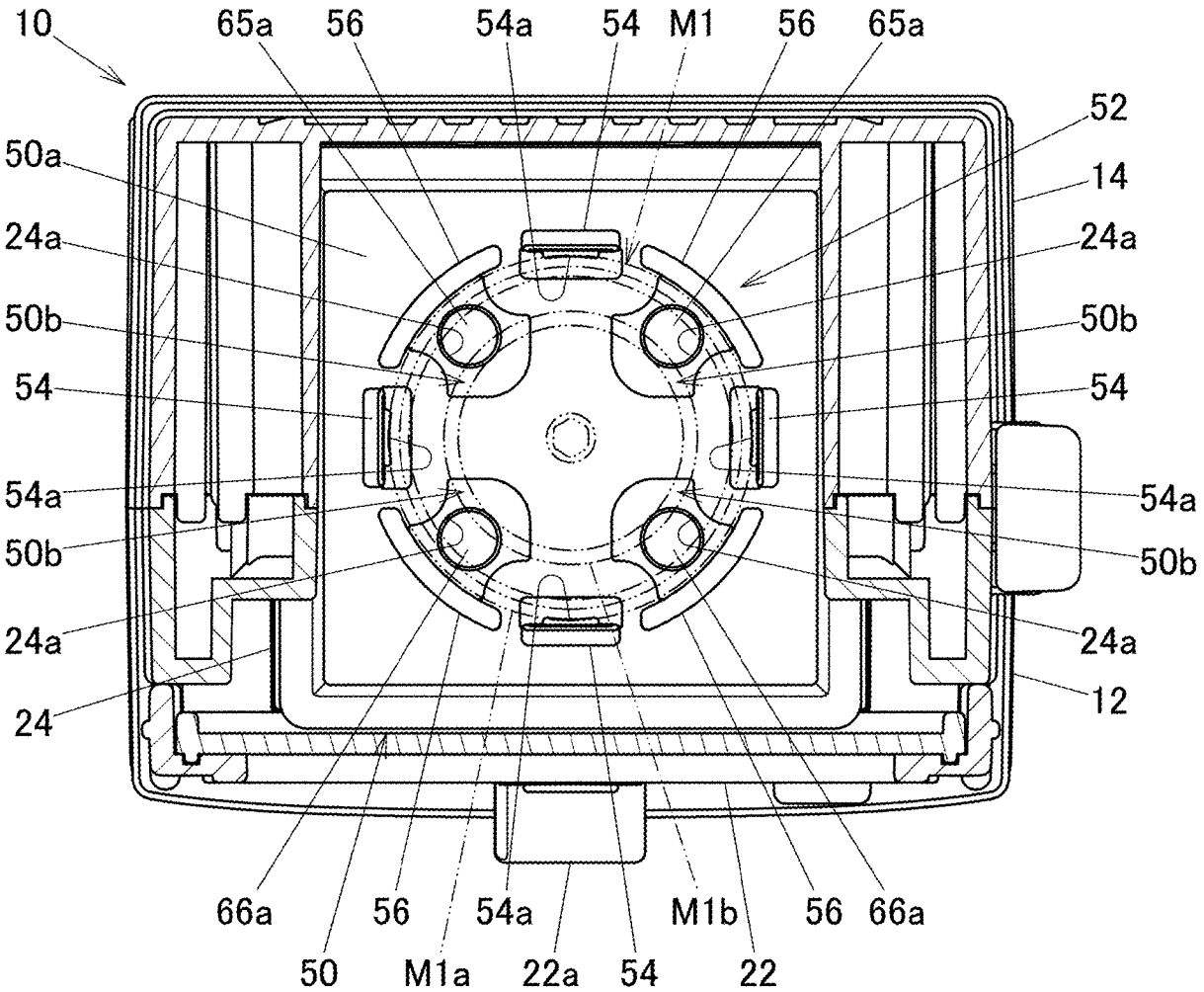
FIG. 8 is a cross-sectional view taken along line VIII-VIII in FIG. 1, showing the cake piece in a transparent view.

Next, an aspect of storing the cake model M1 in the storing part 52 will be described with reference to FIG. 8. Note that in FIG. 8, the cake model M1 is depicted as a transparent view with a two-dot chain line. As shown in FIG. 8, the cake model M1 is stored on an inner side of the storing part 52 with almost no gap. Here, a height of the outer peripheral wall M1*a* of the cake model M1 substantially matches the rising heights of each holding portion 54 and each non-holding portion 56 of the storing part 52. For this reason, the cake model M1 stored in the storing part 52 is held in the storing part 52 such that a portion of the outer peripheral wall M1*a* facing the claw portion 54*a* of each holding portion 54 is pressed inward by the claw portion 54*a* as each holding portion 54 elastically deforms.

In addition, as shown in FIG. 8, in the state in which the cake model M1 is stored in the storing part 52, the pins 65*a* and 66*a* exposed upward from the main body-side through holes 24*a* and the tray-side through holes 50*b* overlap both the outer peripheral wall M1*a* and the inner peripheral wall M1*b* of the cake model M1 in the vertical direction. For this reason, when the respective pins 65*a* and 66*a* protrude upward from the tray-side through holes 50*b*, both the outer peripheral wall M1*a* and the inner peripheral wall M1*b* are pushed upward by the respective pins 65*a* and 66*a*, so that the cake model M1 rises upward, and the upper part of the cake model M1 protrudes upward from the storing part 52.

In the oven toy 1 of the present embodiment configured as described above, when the switch portion 32 is rotationally operated in the state in which the cake model M1 is placed in the storing part 52, a state is switched between a state (hereinafter, referred to as the "pre-cooking state") in which each of the pins 65*a* and 66*a* does not protrude upward from the tray-side through hole 50*b* and a state (hereinafter, referred to as the "post-cooking state") in which each of the pins 65*a* and 66*a* protrudes upward from the tray-side through hole 50*b*. In the pre-cooking state, the rotation shaft 64 is arranged in a rotational posture in which the first interference portion 64*f* extends leftward from the outer peripheral surface of the rotation shaft 64.

Next, an operation when a user plays with the oven toy 1 using the cake model M1, which is a cooking object, will be described with reference to FIGS. 9A to 9C and FIGS. 10A to 10C. When playing with the oven toy 1, the user first stores the cake model M1 in the storing part 52 of the first tray 50, opens the door portion 22 of the oven 20 in the pre-cooking state, places the first tray 50 on the placement plate 24, and closes the door portion 22 (state shown in FIG. 9A). Thereby, the user can feel as if the user has put an unrisen sponge cake into the oven 20.

Figure 10A:
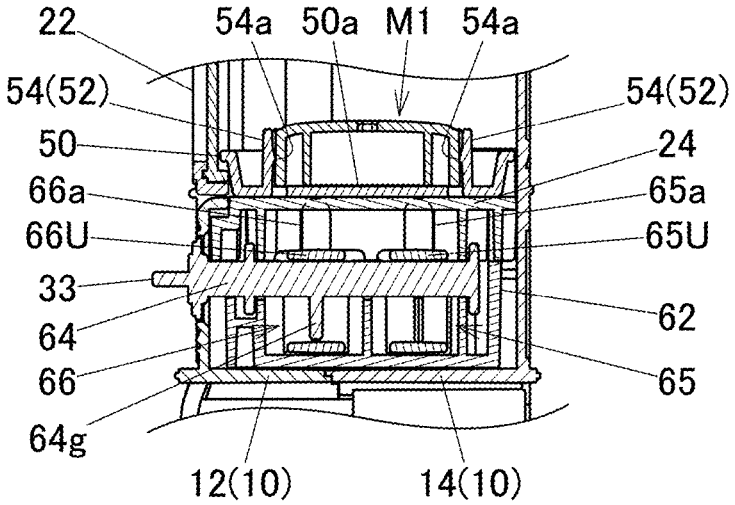

In the pre-cooking state, as shown in FIG. 10A, neither the first pins 65*a* nor the second pins 66*a* protrude upward from the tray-side through holes 50*b*, and both the first moving part 65 and the second moving part 66 are located inside the housing 62. In addition, in the pre-cooking state, the counterclockwise rotation of the rotation shaft 64 is regulated by the rotation regulating portion 64*b* 1 coming into contact with the left fourth wall portion 62W4L. In addition, in the pre-cooking state, the covered portion 62*a*1 is covered by the covering portion 64*d*, so the covering portion 64*d* is exposed from the display portion 34, and a color scheme of the covering portion 64*d* is displayed in the display portion 34.

From the pre-cooking state, when the user starts rotating the switch portion 32 clockwise, the first interference portion 64*f* of the rotation shaft 64 interferes with the upper portion 65U of the first moving part 65, and the first moving part 65 is pushed upward by the first interference portion 64*f* together with the first pins 65*a*. At this time, the chamfered tip end portion of the first interference portion 64*f* allows the first moving part 65 to be smoothly pushed upward. Then, when the user rotates the switch portion 32 clockwise by approximately 90 degrees (first angle), the first interference portion 64*f* assumes an upwardly extending posture and reaches its most upward position as the first moving part 65 is pushed up, causing the two first pins 65*a* to protrude upward from the tray-side through holes 50*b* (see FIG. 10B). Hereinafter, this state is called the "semi-cooking state."

Figure 10B:
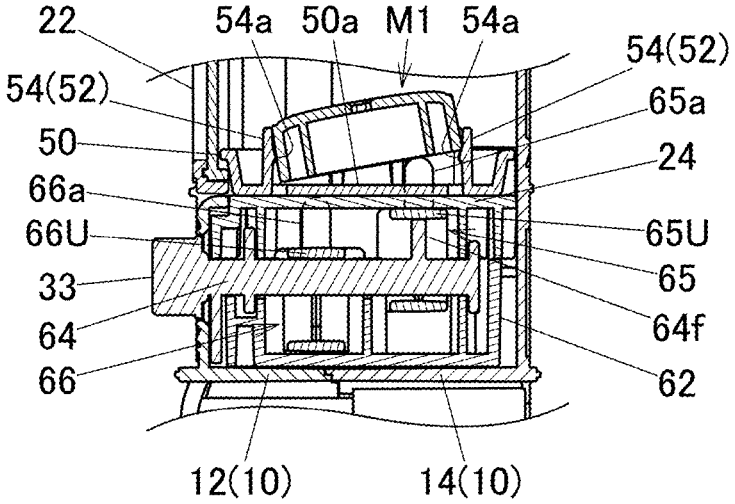

In the semi-cooking state, as shown in FIG. 10B, a rear part of the cake model M1 stored in the first tray 50 is pushed upward by the two first pins 65*a* and is raised, separating from the bottom surface 50*a*. The raised rear part of the cake model M1 goes over the claw portion 54*a*, rides onto the claw portion 54*a*, and is maintained in a locked posture on the claw portion 54*a*. The rear part of the cake model M1 rises in this way, so that the user gets the impression that a part of the sponge cake has risen inside the oven 20.

Figure 9C:
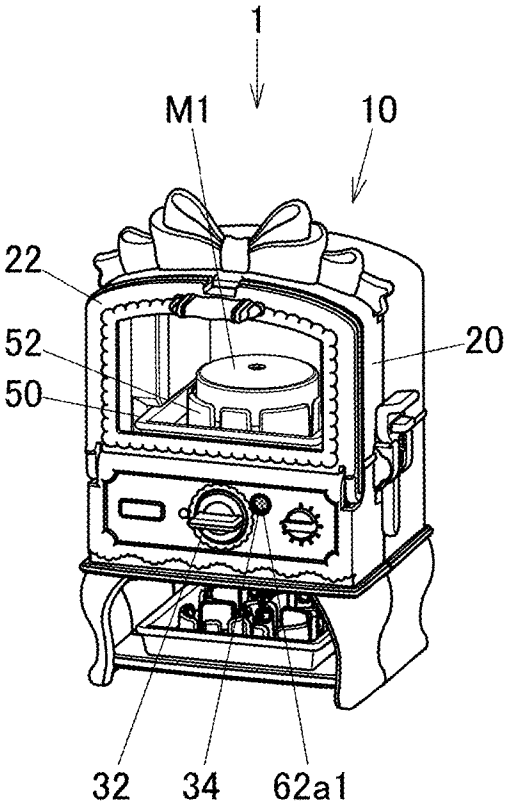
Figure 9B:
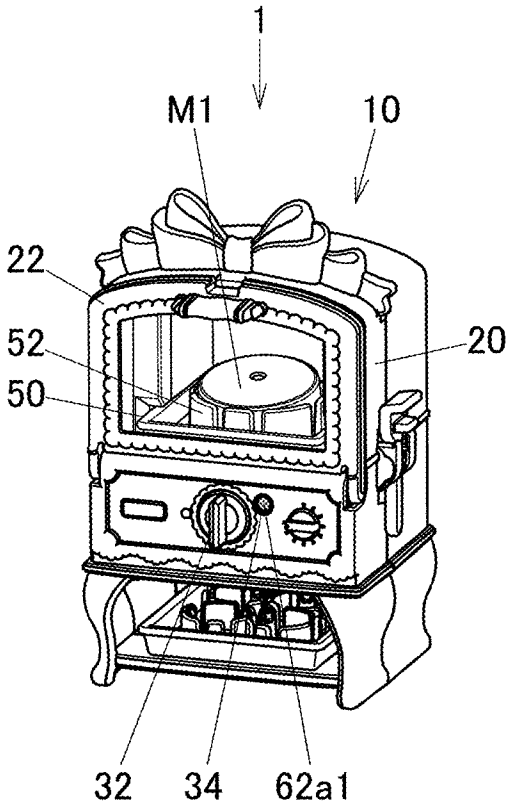
Figure 9A:
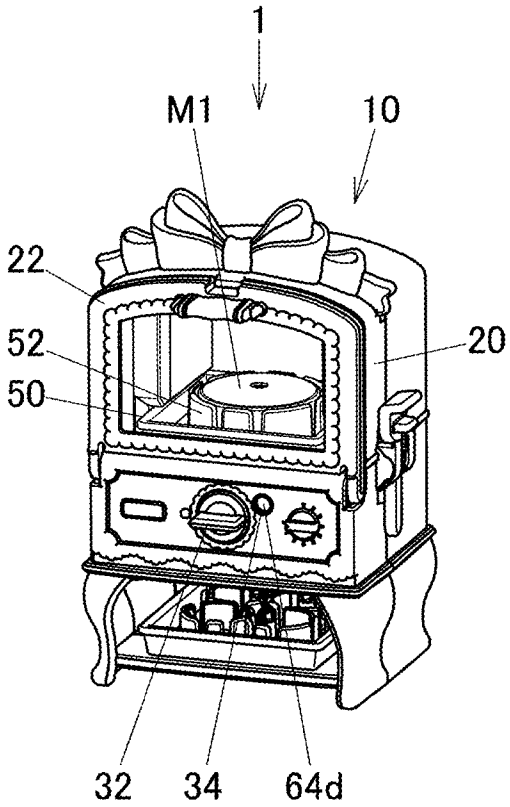

In addition, the rotation shaft 64 rotates from the pre-cooking state and transitions to the semi-cooking state, so the covered portion 62*a*1 of the housing 62 is not covered by the covering portion 64*d*, which is a part of the rotation shaft 64, and thus the covered portion 62*a*1 is exposed from the display portion 34 (see FIG. 9B). Here, when the covered portion 62*a*1 and the covering portion 64*d* have different color schemes, for example, when the covered portion 62*a*1 has a darker color scheme than the covering portion 64*d*, the display visible from the display portion 34 switches from a light color scheme to a darker color scheme, so the user feels as if the oven 20 has been turned on as the state switches from the pre-cooking state to the semi-cooking state.

From the semi-cooking state, when the user starts further rotating the switch portion 32 clockwise, the second interference portion 64*g* of the rotation shaft 64 interferes with the upper portion 66U of the second moving part 66, and the second moving part 66 is pushed upward by the second interference portion 64*g* together with the second pins 66*a*. At this time, the chamfered tip end portion of the second interference portion 64*g* allows the second moving part 66 to be smoothly pushed upward. Then, when the user further rotates the switch portion 32 clockwise by approximately 90 degrees, that is, when the user rotates the switch portion 32 by approximately 180 degrees (second angle) from the pre-cooking state, the second interference portion 64*g* assumes an upwardly extending posture and reaches its most upward position as the second moving part 66 is pushed up, causing the two second pins 66*a* to protrude upward from the tray-side through holes 50*b* (see FIG. 10C). Hereinafter, this state is called the "post-cooking state."

Note that the first interference portion 64*f* of the rotation shaft 64 start descending downward along with the rotation of the rotation shaft 64 during the transition from the semi-cooking state to the post-cooking state, and the first moving part 65 interfering with the first interference portion 64*f* moves downward by its own weight together with the first interference portion 64*f* and is stored again within the housing 62. As the first moving part 65 moves downward, the first pins 65*a* also move downward. The rear part of the cake model M1 raised by the first pins 65*a* is locked on the claw portion 54*a* in the semi-cooking state, and thus, during the transition from the semi-cooking state to the post-cooking state, it separates from the first pins 65*a* and maintains the raised posture (see FIG. 10C).

Figure 10C:
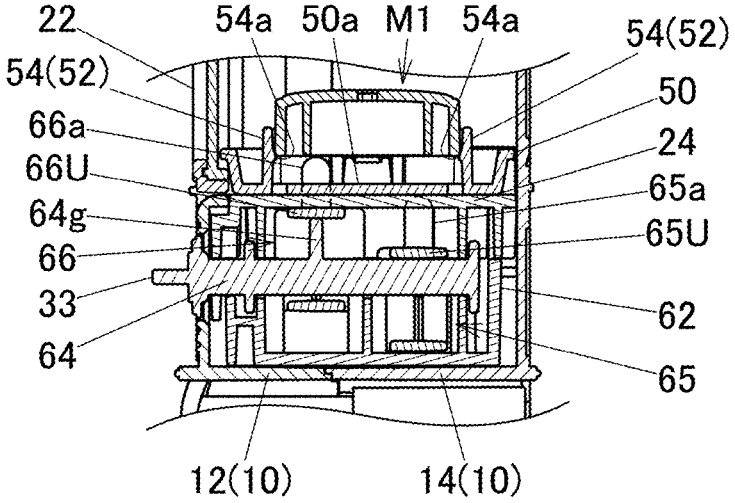

In the post-cooking state, as shown in FIG. 10C, a front part of the cake model M1 stored in the first tray 50 is pushed upward by the two second pins 66*a* and is raised, separating from the bottom surface 50*a*. The raised front part of the cake model M1 goes over the claw portion 54*a*, rides onto the claw portion 54*a*, and is maintained in a locked posture on the claw portion 54*a*. As a result, by transitioning to the post-cooking state, the rear and front parts of the cake model M1, that is, the entire cake model M1, take on a raised posture, and the user gets the impression that the entire sponge cake has risen inside the oven 20.

Note that, even during the transition from the semi-cooking state to the post-cooking state, since the covered portion 62*a*1 of the housing 62 is not covered by the covering portion 64*d*, which is a part of the rotation shaft 64, the covered portion 62*a*1 remains exposed through the display portion 34 (see FIG. 9C). As a result, the user feels as if the oven 20 remains powered on even during the transition from the semi-cooking state to the post-cooking state. In addition, in the post-cooking state, the clockwise rotation of the rotation shaft 64 is regulated by the rotation regulating portion 64*b*1 coming into contact with the right fourth wall portion 62W4R.

When removing the first tray 50 from the oven 20 after the transition from the pre-cooking state to the post-cooking state, the user rotates the switch portion 32 counterclockwise by approximately 90 degrees to return the switch portion 32 to the rotation position of the semi-cooking state, and then further rotates the switch portion 32 counterclockwise by approximately 90 degrees to return the switch portion 32 to the rotation position of the pre-cooking state. During the return from the post-cooking state to the semi-cooking state, the first interference portion 64*f* of the rotation shaft 64 interferes again with the upper portion 65U of the first moving part 65, and the first moving part 65 is pushed upward by the first interference portion 64*f* together with the first pins 65*a*.

In addition, during the return from the post-cooking state to the semi-cooking state, the second interference portion 64*g* of the rotation shaft 64 starts descending downward along with the rotation of the rotation shaft 64, and the second moving part 66 interfering with the second interference portion 64*g* moves downward by its own weight together with the second interference portion 64*g* and is stored again within the housing 62. In this way, the rotational motion of the rotation shaft 64 is converted into the reciprocating motion in the vertical direction of the second moving part 66 by the second interference portion 64*g*. As the second moving part 66 moves downward, the second pins 66*a* also moves downward. The front part of the cake model M1 raised by the second pins 66*a* is locked on the claw portion 54*a* in the post-cooking state, and thus, during the return from the post-cooking state to the semi-cooking state, it separates from the second pins 66*a* and maintains the raised posture.

During the return from the semi-cooking state to the pre-cooking state, the first interference portion 64*f* of the rotation shaft 64 starts descending downward along with the rotation of the rotation shaft 64, and the first moving part 65 interfering with the first interference portion 64*f* moves downward by its own weight together with the first interference portion 64*f* and is stored again within the housing 62. At this time, even if the first moving part 65 does not move downward by its own weight, the first interference portion 64*f* interferes with the first protruding portion 65*b*, the first protruding portion 65*b* is pushed downward along with the rotation of the first interference portion 64*f*, and the first moving part 65 moves downward together with the first protruding portion 65*b*. In this way, the rotational motion of the rotation shaft 64 is converted into the reciprocating motion in the vertical direction of the first moving part 65 by the second interference portion 64*f*.

By returning from the post-cooking state to the pre-cooking state in this way, both the first moving part 65 and the second moving part 66 are stored again within the housing 62, and the two first pins 65*a* and the two second pins 66*a* return to the positions where they do not protrude upward from the tray-side through holes 50*b* (the position in the pre-cooking state). For this reason, the user can open the door portion 22 and take out the first tray 50 from the inside of the oven 20. The cake model M1 stored in the first tray 50 inside the oven 20 maintains the raised posture (rising state) because it is entirely locked on the claw portions 54*a*.

Note that since the first moving part 65 and the second moving part 66 are the same member, even if the first moving part 65 and the second moving part 66 are stored at opposite positions within the housing 62 during the manufacturing process and the assembling process of the oven toy 1, during the return from the semi-cooking state to the pre-cooking state, the second interference portion 64*g* interferes with the second protruding portion 66*b*, so the second protruding portion 66*b* is pushed downward along with the rotation of the second interference portion 64*g*, and the second moving part 66 moves downward together with the second protruding portion 66*b*.

As described above, in the oven toy 1 according to the first embodiment of the present disclosure, the user stores the cake model M1 in the storing part 52 of the first tray 50, opens the door portion 22, places the first tray 50 on the placement plate 24, and closes the door portion 22. Then, when the user rotationally operates the switch portion 32 clockwise by approximately 90 degrees, the state transitions from the pre-cooking state to the semi-cooking state, and the rear half of the cake model M1 is raised. When the user further rotationally operates the switch portion 32 clockwise by approximately 90 degrees, the state transitions from the semi-cooking state to the post-cooking state, and the entire cake model M1 is raised.

As a result, the user gets the impression that the sponge cake (cake model) has risen gradually in stages inside the oven 20. Thereafter, the user can open the door portion 22 and take out the first tray 50 together with the cake model M1 in the rising (raised) state by rotationally operating the switch portion 32 counterclockwise by approximately 180 degrees to return the state from the post-cooking state to the pre-cooking state. As a result, the user playing with the oven toy 1 can feel as if the user has baked and cooked a sponge cake inside the oven 20, and can easily enjoy a play imitating a state change before and after cooking.

Second Embodiment

Next, a second embodiment of the present disclosure will be described with reference to FIGS. 11 to 14C. The second embodiment describes an embodiment in which a user plays with the oven toy 1 using the second tray 150 (see FIG. 1). Since the configuration of the oven toy 1 is similar to that of the first embodiment, the description thereof is omitted. In the second embodiment, the second tray 150 is placed on the placement plate 24, and four small cake models (shape bodies) M2 described below are stored in the second tray 150.

Figure 11:
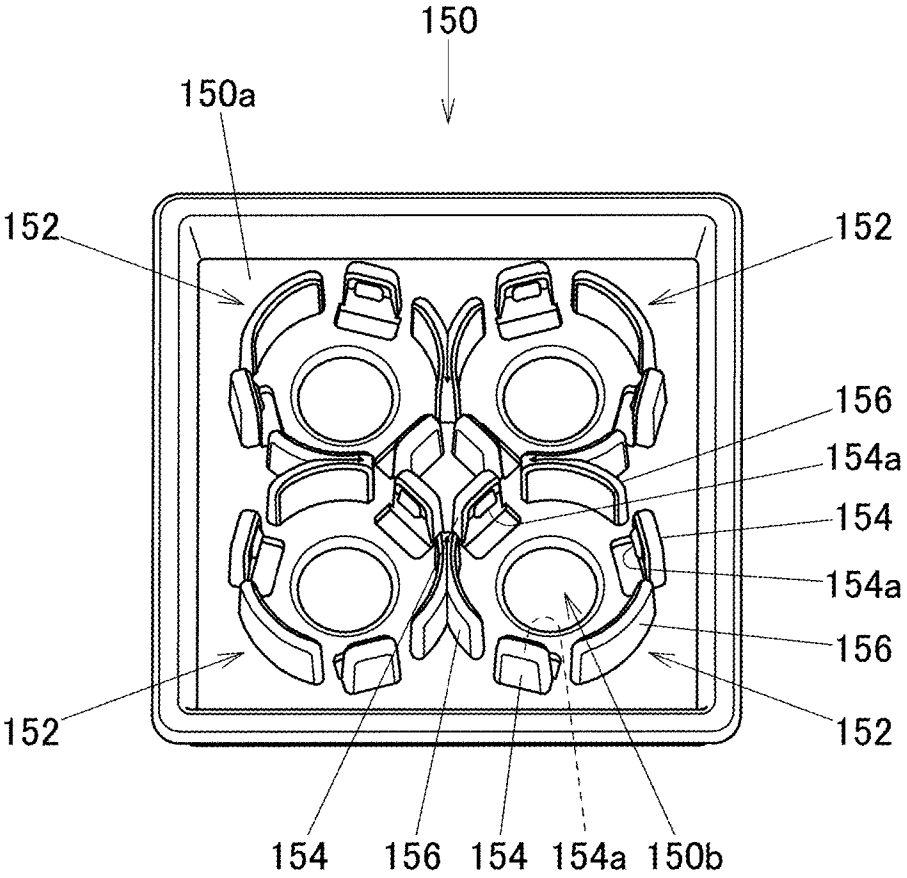
FIG. 11 is a perspective view of a tray of an oven toy according to a second embodiment of the present disclosure as viewed from above.

First, the configuration of the second tray 150 will be described with reference to FIG. 11. As shown in FIG. 11, the second tray 150 has a shallow dish shape, which has a substantially square shape when viewed from above. On a bottom surface 150*a* of the second tray 150, four storing parts 152 in which small cake models M2 described below are stored are provided. Each storing part 152 is constituted by wall portions rising from the bottom surface 150*a* of the second tray 150, is the same in shape and size, and has a substantially circular shape following an outer peripheral surface of the small cake model M2 when viewed from above. The four storing parts 152 are provided adjacent to each other in the front-rear and left-right directions in the form of being aligned in two rows each in the front-rear and left-right directions on the bottom surface 150*a*.

The wall portions constituting each storing part 152 are intermittently provided in the form of being divided into six pieces, and among them, the three wall portions arranged in a substantially circular shape at intervals of 120 degrees (wall portions provided in a substantially straight-line shape when viewed from above) serve as holding portions 154 that hold the small cake model M2, and the other three wall portions (wall portions provided in a substantially arc shape when viewed from above) serve as non-holding portions 156. An inner surface side of each holding portion 154 is provided with a claw portion 154*a* protruding in a claw shape toward the inner side (a center side of the second tray 150). Note that in the storing part 152 of the bottom surface 150*a* of the second tray 150, an opening is provided at a portion located directly below each holding portion 154 along a base end portion of each holding portion 154, and thus, each holding portion 154 is easily elastically deformed in a leaf spring-like manner both inward and outward of the second tray 150.

In addition, in the storing part 152 of the bottom surface 150*a* of the second tray 150, a tray-side through hole 150*b*, which is an opening, is provided at a portion located on an inner side of each non-holding portion 156. Each tray-side through hole 150*b* is provided at a position, which overlaps each main body-side through hole 24*a* in the vertical direction when the second tray 150 is placed on the placement plate 24, and each of the pins 65*a* and 66*a* can pass therethrough (see FIG. 13).

Figure 12A:
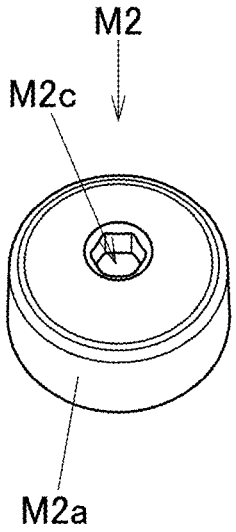
FIG. 12A is a perspective view of a small cake piece as viewed from above.
Figure 12B:
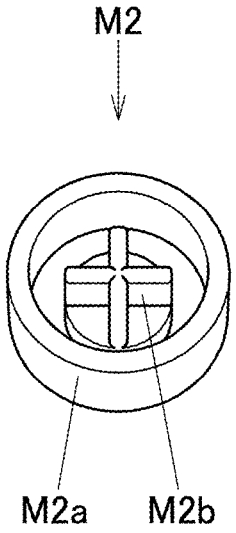
FIG. 12B is a perspective view of the small cake piece as viewed from below.

Next, the small cake model M2 that is stored in the storing part 152 will be described with reference to FIGS. 12A and 12B. The small cake model M2 is a figure body imitating a sponge cake (cooking object) slightly smaller than the cake model M1 described in the first embodiment, and is a short cylindrical member with a closed upper opening. A diameter of each small cake model M2 is about half the diameter of the cake model M1. As shown in FIG. 12B, an inner side of an outer peripheral wall M2*a* of the small cake model M2 is provided with a substantially cross-shaped rib wall M2*b*. In addition, as shown in FIGS. 12A and 12B, a recess M2*c*, which is concave downward, is provided at a central portion of an upper surface of the small cake model M2.

Figure 13:
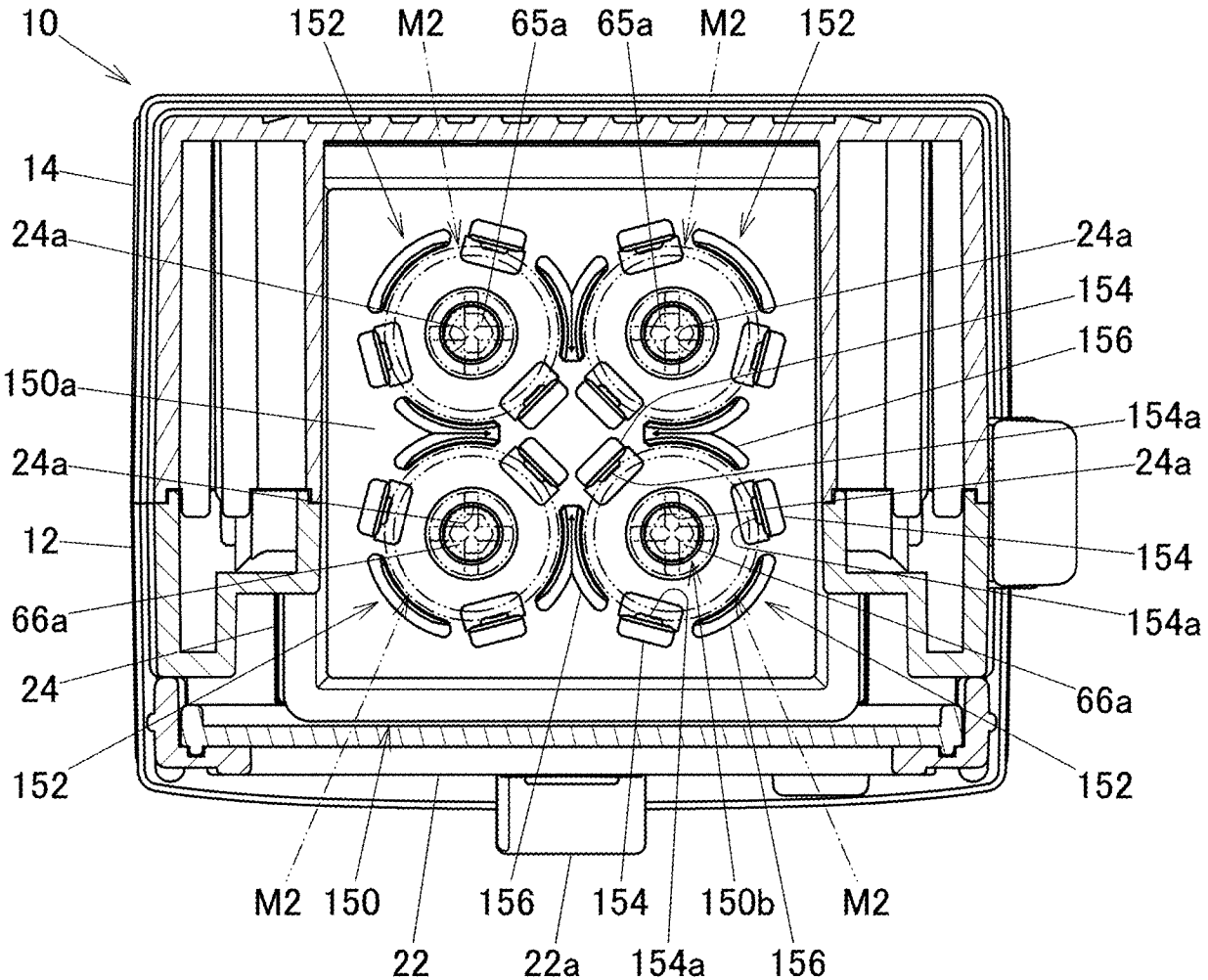
FIG. 13 is a cross-sectional view corresponding to FIG. 8, showing the small cake piece in a transparent view.

Next, an aspect of storing the small cake model M2 in the storing part 152 will be described with reference to FIG. 13. Note that in FIG. 13, each small cake model M2 is depicted as a transparent view with a two-dot chain line. As shown in FIG. 13, each small cake model M2 is stored on an inner side of each storing part 152 with almost no gap. Here, a height of the outer peripheral wall M1*a* of each small cake model M2 substantially matches the rising heights of each holding portion 154 and each non-holding portion 156 of each storing part 152. For this reason, the small cake model M2 stored in each storing part 152 is held in the storing part 152 such that the portion of the outer peripheral wall M1*a* facing the claw portion 154*a* of each holding portion 154 is pressed inward by the claw portion 154*a* as each holding portion 154 elastically deforms.

In addition, as shown in FIG. 13, in the state in which each small cake model M2 is stored in each storing part 152, the pins 65*a* and 66*a* exposed upward from the main body-side through holes 24*a* and the tray-side through holes 50*b* overlap the rib wall M2*b* of each small cake model M2 in the vertical direction. For this reason, when the respective pins 65*a* and 66*a* protrude upward from the tray-side through holes 50*b*, the rib wall M2*b* is pushed upward by the respective pins 65*a* and 66*a*, so that the small cake model M2 is raised upward, and the upper part of the small cake model M2 protrudes upward from the storing part 52.

Figure 14A:
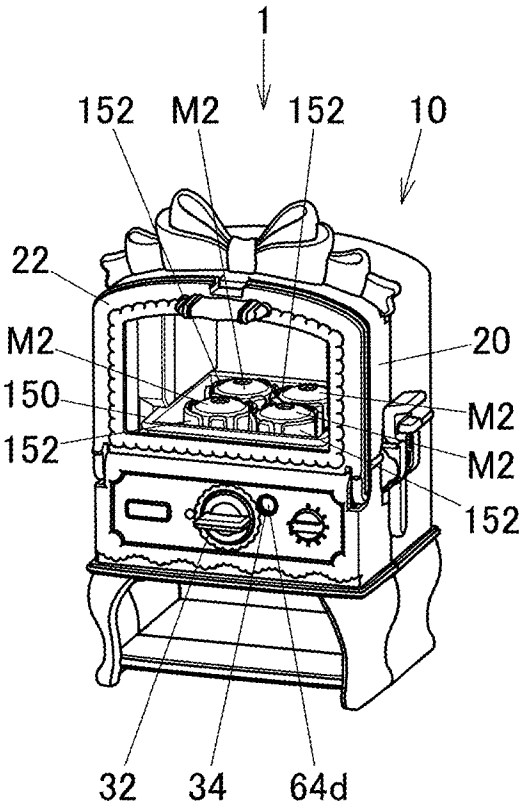

Next, an operation when the user plays with the oven toy 1 using the small cake model M2, which is the cooking object, will be described with reference to FIGS. 14A to 14C. When playing with the oven toy 1, the user first stores the small cake model M2 in each storing part 152 of the second tray 150, opens the door portion 22 of the oven 20 in the pre-cooking state, places the second tray 150 on the placement plate 24, and closes the door portion 22 (state shown in FIG. 14A). Thereby, the user can feel as if the user has put four small unrisen sponge cakes into the oven 20.

Figure 14B:
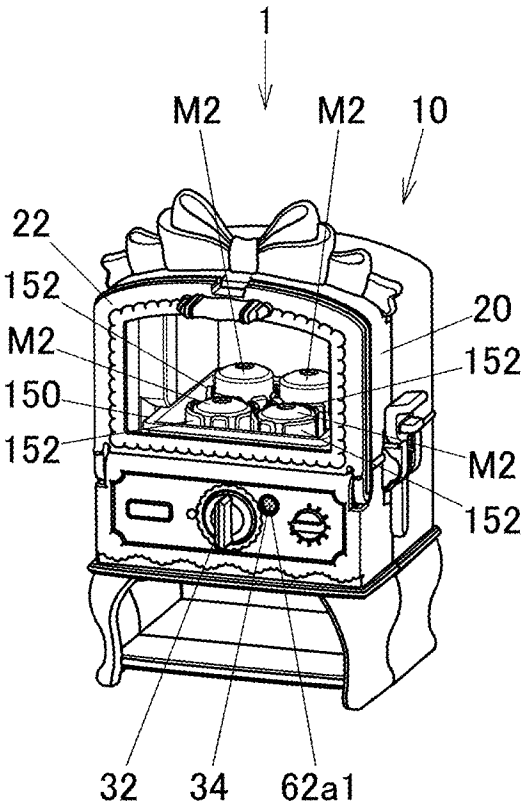

When the user rotates the switch portion 32 clockwise to transition from the pre-cooking state to the semi-cooking state, each small cake model M2 stored in each of the two storing parts 152 provided on the rear side of the second tray 150 is entirely pushed upward by the two first pins 65*a* and is raised, separating from the bottom surface 50*a* (see FIG. 14B). The two raised small cake models M2 go over the claw portions 154*a*, ride onto the claw portions 154*a*, and are maintained in a locked posture on the claw portions 154*a*. As a result, the user gets the impression that two small sponge cakes stored on the rear side of the second tray 150 inside the oven 20 have risen.

Figure 14C:
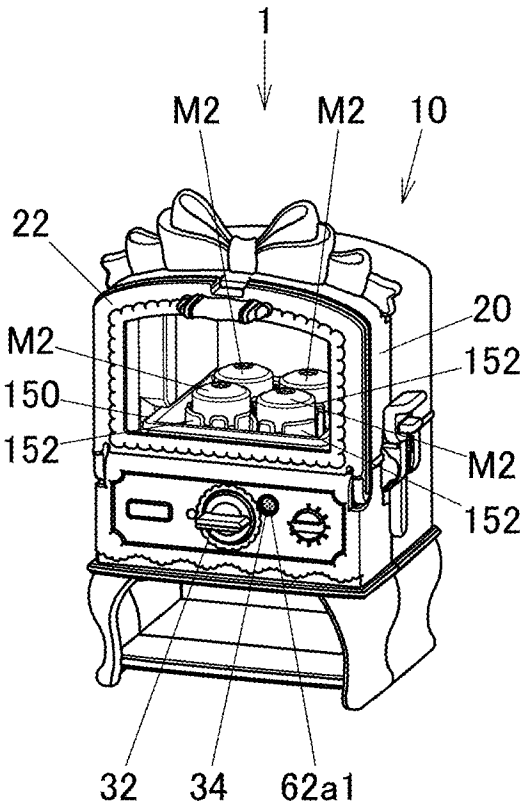

When the user further rotates the switch portion 32 clockwise to transition from the semi-cooking state to the post-cooking state, each small cake model M2 stored in each of the two storing parts 152 provided on the front side of the second tray 150 is entirely pushed upward by the two second pins 66*a* and is raised, separating from the bottom surface 50*a* (see FIG. 14C). The two raised small cake models M2 go over the claw portions 154*a*, ride onto the claw portions 154*a*, and are maintained in a locked posture on the claw portions 154*a*. As a result, the user gets the impression that two small sponge cakes stored on the front side of the second tray 150 inside the oven 20 have risen.

Note that the two cake models M1 raised by the first pins 65*a* are locked on the claw portions 154*a* in the semi-cooking state, and thus, during the transition from the semi-cooking state to the post-cooking state, they separate from the first pins 65*a* and maintain the raised postures. As a result, by transitioning to the post-cooking state, all the four cake models M1 stored in the second tray 150 take on the raised postures, and the user gets the impression that all the four small sponge cakes have risen inside the oven 20.

As described above, in the oven toy 1 according to the second embodiment of the present disclosure, the user stores the small cake models M2 in the storing parts 152 of the second tray 150, respectively, opens the door portion 22, places the second tray 150 on the placement plate 24, and closes the door portion 22. Then, when the user rotationally operates the switch portion 32 clockwise by approximately 90 degrees, the state transitions from the pre-cooking state to the semi-cooking state, and the two small cake models M1 on the second tray 150 are raised. When the user further rotationally operates the switch portion 32 clockwise by approximately 90 degrees, the state transitions from the semi-cooking state to the post-cooking state, and the two remaining cake models M1 are raised.

As a result, the user gets the impression that the four small sponge cakes (cake models) have individually risen inside the oven 20. Thereafter, the user can open the door portion 22 and take out the second tray 150 together with the respective cake models M2 in the rising (raised) state by rotationally operating the switch portion 32 counterclockwise by approximately 180 degrees to return the state from the post-cooking state to the pre-cooking state. As a result, the user playing with the oven toy 1 can feel as if the user has baked and cooked sponge cakes inside the oven 20, and can easily enjoy a play imitating a state change before and after cooking.

According to the above-described embodiments of the present disclosure, a model toy and a cooking toy of the following aspects can be provided.

A model toy according to a first aspect includes: a main body; a placement table provided in the main body and having at least one main body-side through hole penetrating through the placement table in a vertical direction; a tray having at least one tray-side through hole penetrating through the tray in the vertical direction and being placed on the placement table such that the at least one tray-side through hole overlaps the at least one main body-side through hole in the vertical direction; a rotation shaft provided below the placement table; an operation part provided in the main body and configured to rotationally operate the rotation shaft; at least one conversion part provided around an axis of the rotation shaft and configured to convert a rotational motion of the rotation shaft around the axis into a reciprocating motion in the vertical direction; and at least one moving part provided between the placement table and the at least one conversion part and configured to move in the vertical direction by interference with the at least one conversion part in accordance with a rotation of the rotation shaft around the axis, in which the at least one moving part includes at least one penetration portion configured to pass through the at least one main body-side through hole and the at least one tray-side through hole and protrude upward from the at least one tray-side through hole by moving upward. With this configuration, by placing the tray on the placement table and rotationally operating the rotation shaft through the operation part, the penetration portion of the moving part can be caused to protrude upward from the tray via the conversion part of the rotation shaft. Accordingly, for example, when the rotation shaft is rotationally operated in a state in which a figure body imitating a cooking object is stored in the tray, the figure body in the tray is pushed up and raised by the penetration portion, giving the impression that the figure body has risen and been cooked. In this way, by rotationally operating the rotation shaft through the operation part, the figure body in the tray changes from the pre-cooking state the post-cooking state, so the user can easily and effectively enjoy a play that imitates a state change before and after cooking.

In the model toy according to a second aspect, the at least one conversion part has a shape protruding radially from an outer peripheral surface of the rotation shaft.

With this configuration, by making a protruding length of the conversion part larger than a distance between the conversion part and the moving part, the conversion part can be caused to interfere with the moving part as the rotation shaft rotates. Accordingly, it is possible to provide a specific configuration of the conversion part for converting the rotational motion of the rotation shaft into the vertical motion of the moving part.

In the model toy according to a third aspect, a protruding tip end portion of the at least one conversion part is chamfered.

With this configuration, since the tip end portion of the conversion part is rounded by chamfering, when the moving part is pushed up by the conversion part as the rotation shaft rotates, the moving part is smoothly pushed up by the conversion part along with the rotation of the rotation shaft, compared to, for example, a case where the tip end portion of the conversion part has an angular shape. Accordingly, the upward movement of the moving part by the rotational operation of the rotation shaft can be made smooth.

In the model toy according to a fourth aspect, the rotation shaft includes a covering portion extending radially from an outer peripheral surface of the rotation shaft and configured to cover a part of the main body, and the part of the main body is exposed from the covering portion in accordance with the rotation of the rotation shaft around the axis.

With this configuration, for example, by making a part of the main body covered by the covering portion have a different color scheme from the covering portion, a state in which the color scheme of the covering portion is visible is switched to a state in which the color scheme of the part of the main body exposed from the covering portion is visible as the rotation shaft rotates, so the user can feel as if the model toy has been powered on along with the rotation of the rotation shaft, which enhances the realism of the model toy.

In the model toy according to a fifth aspect, the at least one main body-side through hole has a plurality of main body-side through holes, the at least one tray-side through hole has a plurality of tray-side through holes, a number of the plurality of tray-side through holes corresponding to a number of the plurality of main body-side through holes, the plurality of main body-side through holes includes: a first main body-side through hole group having a first main body-side through hole; and a second main body-side through hole group having a second main body-side through hole, the plurality of tray-side through holes includes: a first tray-side through hole group corresponding to the first main body-side through hole group and having a first tray-side through hole; and a second tray-side through hole group corresponding to the second main body-side through hole group and having a second tray-side through hole, the at least one moving part includes: a first moving part corresponding to the first main body-side through hole group and the first tray-side through hole group; and a second moving part corresponding to the second main body-side through hole group and the second tray-side through hole group, the at least one penetration portion includes: a first penetration portion provided in the first moving part and configured to penetrate the first tray-side through hole and the first main body-side through hole; and a second penetration portion provided in the second moving part and configured to penetrate the second tray-side through hole and the second main body-side through hole, and the at least one conversion part includes: a first conversion part configured to interfere with the first moving part when rotated around the axis of the rotation shaft by a first angle; and a second conversion part configured to interfere with the second moving part when rotated around the axis of the rotation shaft by a second angle greater than the first angle.

With this configuration, the first penetration portion of the first moving part and the second penetration portion of the second moving part protrude upward from the tray at different timings in accordance with the rotation of the rotation shaft. Accordingly, for example, when one figure body is stored in the tray and the rotation shaft is rotationally operated, a portion of the figure body, which overlaps the the penetration portion of the first moving part, and a portion, which overlaps the second penetration portion of the second moving part, are pushed up and raised from the first and second penetration portions at different timings, so the user gets the impression that the figure body has risen gradually in stages. In addition, for example, when a plurality of figure bodies are stored in the tray and the rotation shaft is rotationally operated, a figure body, which overlaps the first penetration portion of the first moving part, among the plurality of figure bodies and a figure body, which overlaps the second penetration portion of the second moving part, are pushed up and raised from the first and second penetration portions at different timings, so the user gets the impression that the plurality of shape bodies have risen individually. As a result, the realism of model toy can be further enhanced.

A cooking toy according to a first aspect includes: a main body; a placement table provided in the main body and having a main body-side through hole penetrating through the placement table in a vertical direction; a tray having a tray-side through hole penetrating through the tray in the vertical direction and being placed on the placement table such that the tray-side through hole overlaps the main body-side through hole in the vertical direction; a rotation shaft provided below the placement table; an operation part provided in the main body and configured to rotationally operate the rotation shaft; a conversion part provided around an axis of the rotation shaft and configured to convert a rotational motion of the rotation shaft around the axis into a reciprocating motion in the vertical direction; a moving part provided between the placement table and the conversion part and configured to move in the vertical direction by interference with the conversion part along with the rotation of the rotation shaft around the axis; and a figure body imitating a shape of a cooking object, in which the tray includes a storing part having the tray-side through hole and configured to allow the figure body to be stored in the storing part so as to be movable upward, in which the moving part includes a penetration portion configured to pass through the main body-side through hole and the tray-side through hole and protrude upward from the tray-side through hole by moving upward.

With this configuration, when a user stores the figure body in the tray, places the tray on the placement table, and rotationally operates the rotation shaft through the operation part, the penetration portion of the moving part protrudes upward from the tray via the conversion part of the rotation shaft, and thus the figure body in the tray is pushed up and raised by the penetration portion. Accordingly, the user gets the impression that the figure body, which is a cooking object, has risen and been cooked in the tray. Accordingly, the user can easily and effectively enjoy a play that imitates a state change before and after cooking.

In the cooking toy according to a second aspect, the storing part includes a claw portion having a claw shape and configured to hold the figure body having moved upward in the storing part.

With this configuration, the figure body raised (having moved upward) in the tray by the rotation operation of the rotation shaft is held at the raised position by the claw portion.

Thus, even when the figure body is raised by rotationally operating the rotation shaft and then the tray is removed from the placement table, the figure body remains raised in the tray. (In other words, the user perceives the cooking object as if it remains in a risen state). Thus, the cooking object remains in a risen state. As a result, the realism of model toy can be further enhanced.

Although the respective embodiments of the present disclosure have been described, the present disclosure is not limited to the respective embodiments described above and can be variously changed without departing from the scope thereof. For example, in the respective embodiments, the cake model and small cake model imitating a sponge cake have been exemplified as the figure body, but no such limitation is intended, and various shape bodies imitating food can be used. In addition, in the respective embodiments, the configuration that protrudes from the rotation shaft in a substantially plate-like shape has been exemplified as the conversion part; however, for example, a crank-shaped portion may be provided on the rotation shaft, as the conversion part. In this case, by arranging the moving part above the crank-shaped portion, the rotational motion of the rotation shaft can be converted into the reciprocating motion of the moving part in the vertical direction by the crank-shaped portion.

What is claimed is:

1. A model toy comprising:

a main body;

a placement table provided in the main body and having at least one main body-side through hole penetrating through the placement table in a vertical direction;

a tray having at least one tray-side through hole penetrating through the tray in the vertical direction and being placed on the placement table such that the at least one tray-side through hole overlaps the at least one main body-side through hole in the vertical direction;

a rotation shaft provided below the placement table;

an operation part provided in the main body and configured to rotationally operate the rotation shaft;

at least one conversion part provided around an axis of the rotation shaft and configured to convert a rotational motion of the rotation shaft around the axis into a reciprocating motion in the vertical direction; and at least one moving part provided between the placement table and the at least one conversion part and configured to move in the vertical direction by interference with the at least one conversion part in accordance with a rotation of the rotation shaft around the axis, wherein the at least one moving part comprises at least one penetration portion configured to pass through the at least one main body-side through hole and the at least one tray-side through hole and protrude upward from the at least one tray-side through hole by moving upward.

2. The model toy according to claim 1, wherein the at least one conversion part has a shape protruding radially from an outer peripheral surface of the rotation shaft.

3. The model toy according to claim 2, wherein a protruding tip end portion of the at least one conversion part is chamfered.

4. The model toy according to claim 1, wherein the rotation shaft comprises a covering portion extending radially from an outer peripheral surface of the rotation shaft and configured to cover a part of the main body portion, and wherein the part of the main body is exposed from the covering portion in accordance with the rotation of the rotation shaft around the axis.

5. The model toy according to claim 1, wherein the at least one main body-side through hole has a plurality of main body-side through holes, wherein the at least one tray-side through hole has a plurality of tray-side through holes, a number of the plurality of tray-side through holes corresponding to a number of the plurality of main body-side through holes, wherein the plurality of main body-side through holes comprises:

a first main body-side through hole group having a first main body-side through hole; and a second main body-side through hole group having a second main body-side through hole, wherein the plurality of tray-side through holes comprises:

a first tray-side through hole group corresponding to the first main body-side through hole group and having a first tray-side through hole; and a second tray-side through hole group corresponding to the second main body-side through hole group and having a second tray-side through hole, wherein the at least one moving part comprises:

a first moving part corresponding to the first main body-side through hole group and the first tray-side through hole group; and a second moving part corresponding to the second main body-side through hole group and the second tray-side through hole group, wherein the at least one penetration portion comprises:

a first penetration portion provided in the first moving part and configured to penetrate the first tray-side through hole and the first main body-side through hole; and a second penetration portion provided in the second moving part and configured to penetrate the second tray-side through hole and the second main body-side through hole, and wherein the at least one conversion part comprises:

a first conversion part configured to interfere with the first moving part when rotated around the axis of the rotation shaft by a first angle; and a second conversion part configured to interfere with the second moving part when rotated around the axis of the rotation shaft by a second angle greater than the first angle.

6. A cooking toy comprising:

a main body;

a placement table provided in the main body and having a main body-side through hole penetrating through the placement table in a vertical direction;

a tray having a tray-side through hole penetrating through the tray in the vertical direction and being placed on the placement table such that the tray-side through hole overlaps the main body-side through hole in the vertical direction;

a rotation shaft provided below the placement table;

an operation part provided in the main body and configured to rotationally operate the rotation shaft;

a conversion part provided around an axis of the rotation shaft and configured to convert a rotational motion of the rotation shaft around the axis into a reciprocating motion in the vertical direction;

a moving part provided between the placement table and the conversion part and configured to move in the vertical direction by interference with the conversion part along with the rotation of the rotation shaft around the axis, and a figure body imitating a shape of a cooking object, wherein the tray comprises a storing part having the tray-side through hole and configured to allow the figure body to be stored in the storing part so as to be movable upward, and wherein the moving part comprises a penetration portion configured to pass through the main body-side through hole and the tray-side through hole and protrude upward from the tray-side through hole by moving upward.

7. The cooking toy according to claim 6, wherein the storing part comprises a claw portion having a claw shape and configured to hold the figure body having moved upward in the storing part.

* * * * *